US008963435B2

(12) United States Patent
Yamazaki

(10) Patent No.: US 8,963,435 B2
(45) Date of Patent: Feb. 24, 2015

(54) LIGHT EMITTING SYSTEM AND LIGHT EMITTING INSTRUCTION APPARATUS

(71) Applicant: Kabushiki Kaisha Kuwagata, Taito-ku (JP)

(72) Inventor: Noriaki Yamazaki, Taito-ku (JP)

(73) Assignee: Kabushiki Kaisha Kuwagata, Taito-Ku, Tokyo (JP)

( * ) Notice: Subject to any disclaimer, the term of this patent is extended or adjusted under 35 U.S.C. 154(b) by 0 days.

(21) Appl. No.: 13/855,778

(22) Filed: Apr. 3, 2013

(65) Prior Publication Data

US 2014/0300279 A1 Oct. 9, 2014

(51) Int. Cl.
*H05B 37/02* (2006.01)

(52) U.S. Cl.
CPC ..... *H05B 37/0272* (2013.01)
USPC ..... 315/158; 315/155

(58) Field of Classification Search
USPC ..... 315/149–152, 155, 158
See application file for complete search history.

(56) References Cited

U.S. PATENT DOCUMENTS

| | | | | |
|---|---|---|---|---|
| 6,859,644 | B2 * | 2/2005 | Wang | 455/159.2 |
| 7,261,433 | B2 * | 8/2007 | Parsons et al. | 362/205 |
| 8,740,391 | B2 | 6/2014 | Leclerc et al. | |
| 2011/0122609 | A1 * | 5/2011 | Dahlin | 362/184 |
| 2014/0184386 | A1 | 7/2014 | Regler et al. | |

FOREIGN PATENT DOCUMENTS

JP 2004-119068 A 4/2004

* cited by examiner

*Primary Examiner* — Jason M Crawford
(74) *Attorney, Agent, or Firm* — Buchanan Ingersoll & Rooney PC

(57) ABSTRACT

An apparatus and a system using an infrared ray for performing a variety of stage effect operations. In a light emitting system including a light emitting instruction apparatus and a light emitting device, the light emitting instruction apparatus includes an infrared output which outputs an infrared signal modulated by a control code, and the light emitting device includes a receiver which receives the infrared signal, an extractor which extracts the control code from the infrared signal acquired by the receiver, a light emitter which emits visible light in a plurality of colors, and a controller which executes drive control of the light emitter. The control code transmitted by the light emitting instruction apparatus includes a plurality of verification codes which verify whether to match with ID codes preliminarily stored in the light emitter.

13 Claims, 6 Drawing Sheets

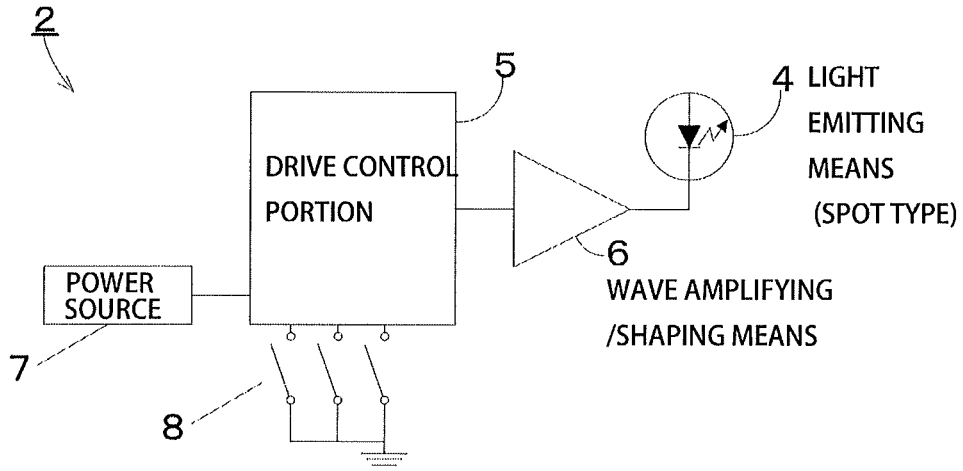
FIG. 1 ( a )
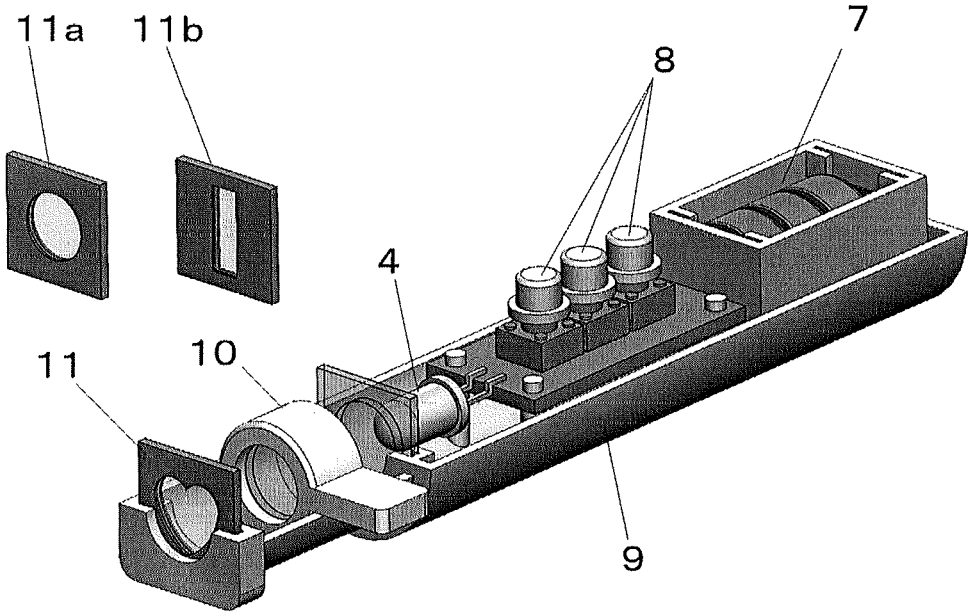
FIG. 1 ( b )

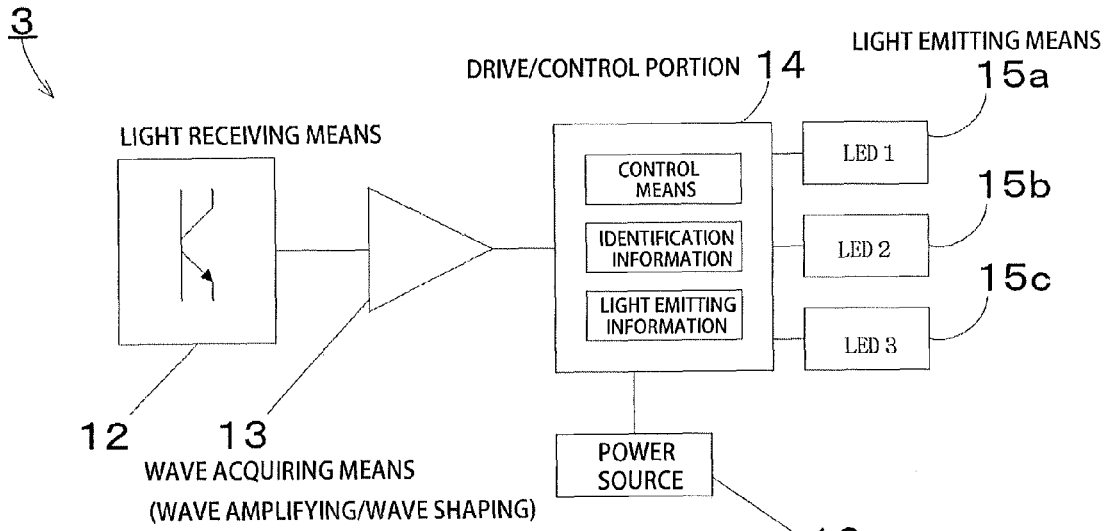
FIG. 2 ( a )
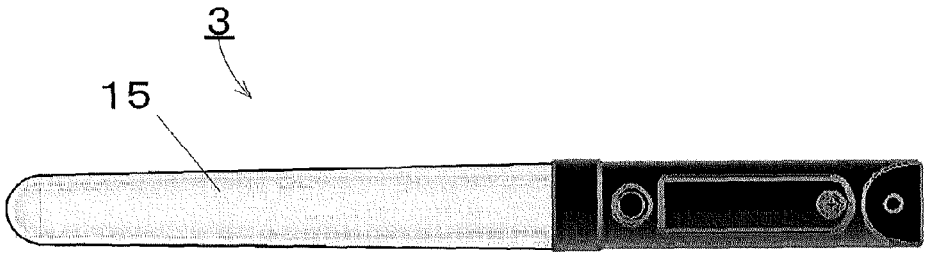
FIG. 2 ( b )

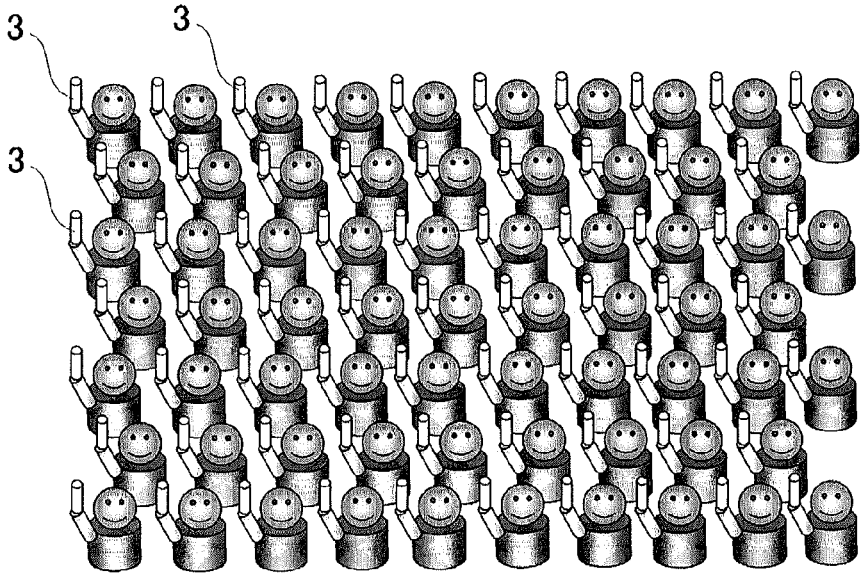
FIG. 5 ( a )
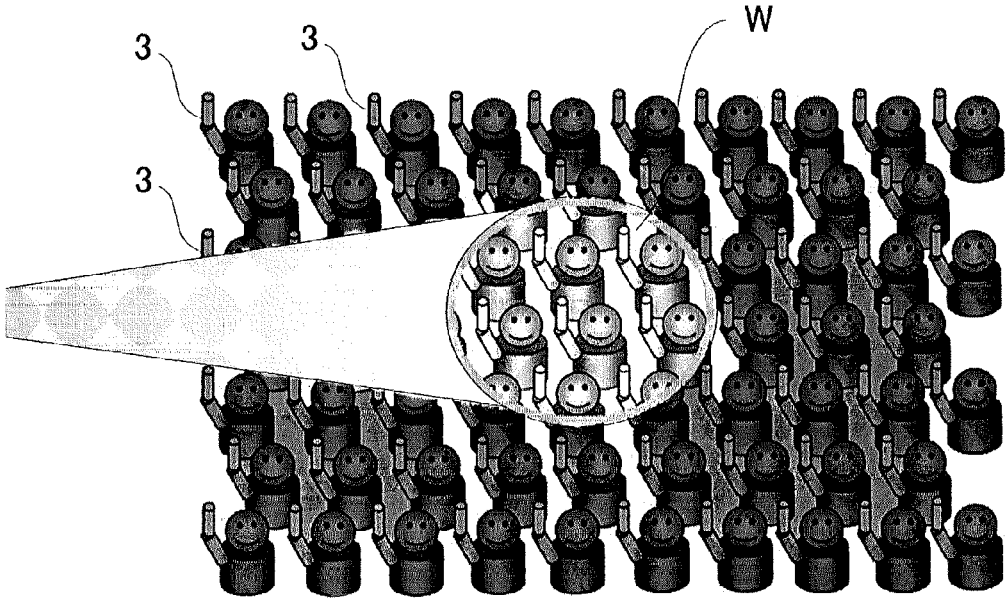
FIG. 5 ( b )

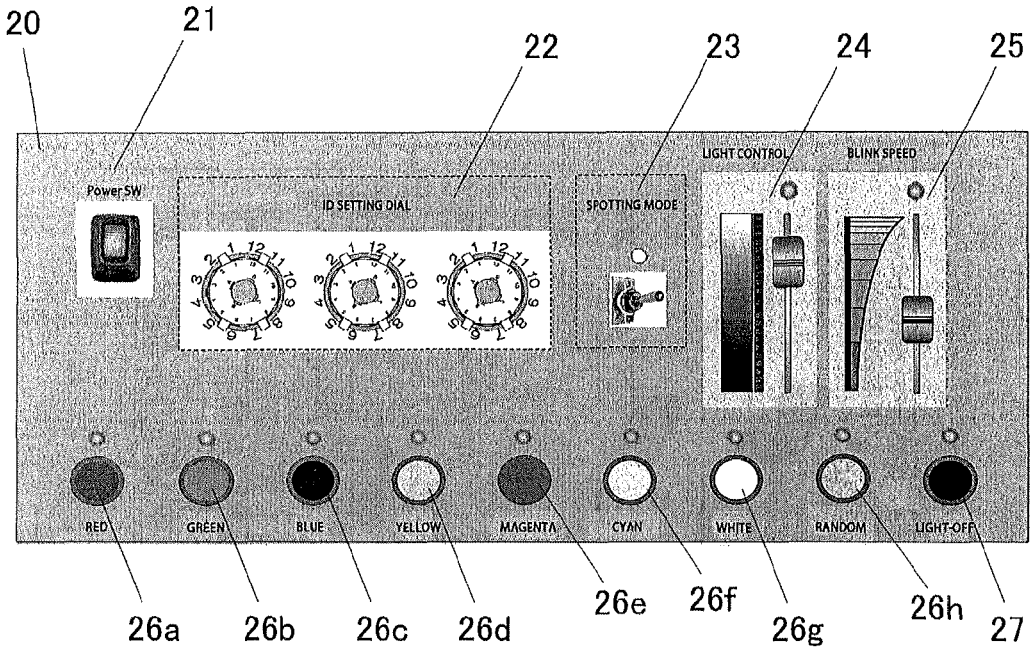
FIG. 6 ( a )
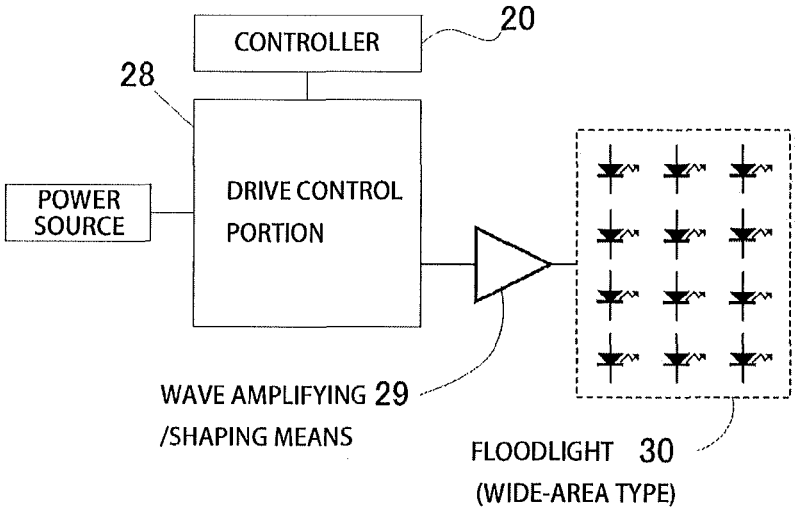
FIG. 6 ( b )

LIGHT EMITTING SYSTEM AND LIGHT EMITTING INSTRUCTION APPARATUS

BACKGROUND OF THE INVENTION

1. Field of the Invention

The present invention relates to a light emitting system and a light emitting instruction apparatus.

2. Description of the Related Art

Conventionally, a stage effect system disclosed in Japanese Patent No. 3910513 has been known. The stage effect system allows each of stage effect devices held by a large number of spectators to perform a predetermined operation based on a control signal included in an infrared signal by emitting the infrared signal from an infrared signal emitting portion at a predetermined timing associated with an event. In addition, the predetermined operation is also performed using a remote control signal used for remote control of household electric appliances by providing the infrared signal emitted from the infrared signal emitting portion to be a modulated signal obtained by amplitude-modulating the control signal with an infrared carrier wave of a frequency substantially equal to a carrier frequency of the remote control signal used for the remote control of household electric appliances.

When it is determined that the received infrared signal is emitted from the infrared signal emitting portion, a data code included in the demodulated signal is compared with a data code stored in the stage effect device. If both of the data codes are coincident with each other, all of the stage effect devices perform the predetermined operation. Accordingly, all operations of the stage effect devices inside a viewing area are performed simultaneously. Thus, light-emitting diodes blink on and off simultaneously at a predetermined timing during an event, for example, a timing associated with the beat of music broadcasted inside the viewing area, or a timing associated with the call of a host.

As a stage effect for an event, all of stage effect devices perform the same operation simultaneously as in the above-described conventional technique. However, when all of the stage effect devices only perform the same operation simultaneously, the stage effects become inflexible and fall short of pleasure.

SUMMARY OF THE INVENTION

The present invention has been made in view of the above-described problem, and an object of the present invention is to provide a light emitting instruction apparatus and a light emitting device using an infrared ray as a control signal, in which a variety of stage effect operations can be performed.

To achieve the above object, the present invention provides the following configurations. According to an aspect of the present invention, a light emitting system includes a light emitting instruction apparatus and a light emitting device. The light emitting instruction apparatus includes an infrared output means which outputs an infrared signal modulated by a control code, and the light emitting device includes a receiving means which receives the infrared signal, an extracting means which extracts the control code from the infrared signal acquired by the receiving means, a light emitting means which emits visible light in a plurality of colors, and a controlling means which executes drive control of the light-emitting means. The control code transmitted by the light emitting instruction apparatus includes a plurality of verification codes which verifies whether or not to be coincident with ID codes preliminarily stored in the light-emitting means, and the plurality of verification codes is prioritized to perform operations with contents of control according to a priority of the received verification codes.

In the light emitting system, upon receipt of a highest prioritized verification code, the light emitting device stores a content of current control and executes another predetermined control temporarily or only for a certain period of time, and performs an operation based on the stored content of the content after the other predetermined control is completed.

Further, in the light emitting system as described above, upon receipt of the highest prioritized verification code, the light emitting device emits light by the light emitting means after storing the content of the current control, and switches off the light emitting means after a lapse of a predetermined time from light emission.

Further, the light emitting system as described above includes a light emitting instruction apparatus a light emitting instruction apparatus which can transmit at least a verification code having the highest priority, and a light emitting instruction apparatus which does not transmit the verification code having the highest priority.

Furthermore, a light emitting instruction apparatus for controlling a light emitting device having a light emitting means for visible light in the above-described light emitting system includes an infrared output means which outputs an infrared signal modulated by a control code, and an optically adjusting means which expands and reduces an illumination range of the outputted infrared signal.

The light emitting instruction apparatus includes a shaping means which shapes an area illuminated by the infrared signal. In addition, the light emitting instruction apparatus includes an instruction means which specifies an emission color.

The light emitting system according to the present invention is provided on the assumption that it is used mainly in a concert hall or the like with a large number of spectators. An object of the present invention is that a light emitting device, such as a penlight, held by each of the spectators emits light in various colors and with various patterns of blinking on/off so as to give a sense of uniformity associated with a course of a concert or the like.

The light emitting system according to the present invention, in order to make the light emitting device emit light as described above, can use a plurality of light emitting instruction apparatuses and includes verification code which are prioritized for executing control instructions. Using a highly prioritized verification code, the light emitting device can perform operations in a prioritized manner over the control of other light emitting instruction apparatuses.

When a control signal emitted with the highly prioritized verification code is received, the light emitting device can be controlled for at least a certain period of time by the content of control instructed by the light emitting instruction apparatus which transmits the highly prioritized verification code. This certain period of time serves as a time period of an interrupt prevention in which the light emitting device performs no operation even when receiving a signal from other light emitting instruction apparatuses, so that the light emitting device can be reliably blinked on/off with the intended emission content.

BRIEF DESCRIPTION OF THE DRAWINGS

FIG. 1(*a*) is an explanatory view of a light emitting instruction apparatus according to the present invention;

FIG. 1(*b*) is an explanatory view of a light emitting instruction apparatus according to the present invention;

FIG. 2(*a*) is an explanatory view of a light emitting device according to the present invention;

FIG. 2(*b*) is an explanatory view of a light emitting device according to the present invention;

FIG. 5(*a*) is an explanatory view of a stage effect, as an example, using the light emitting system according to the present invention;

FIG. 5(*b*) is an explanatory view of a stage effect, as an example, using the light emitting system according to the present invention;

FIG. 6(*a*) is an explanatory view of another light emitting instruction apparatus according to the present invention; and FIG. 6(*b*) is an explanatory view of another light emitting.

DETAILED DESCRIPTION OF EMBODIMENTS

Figure 3:
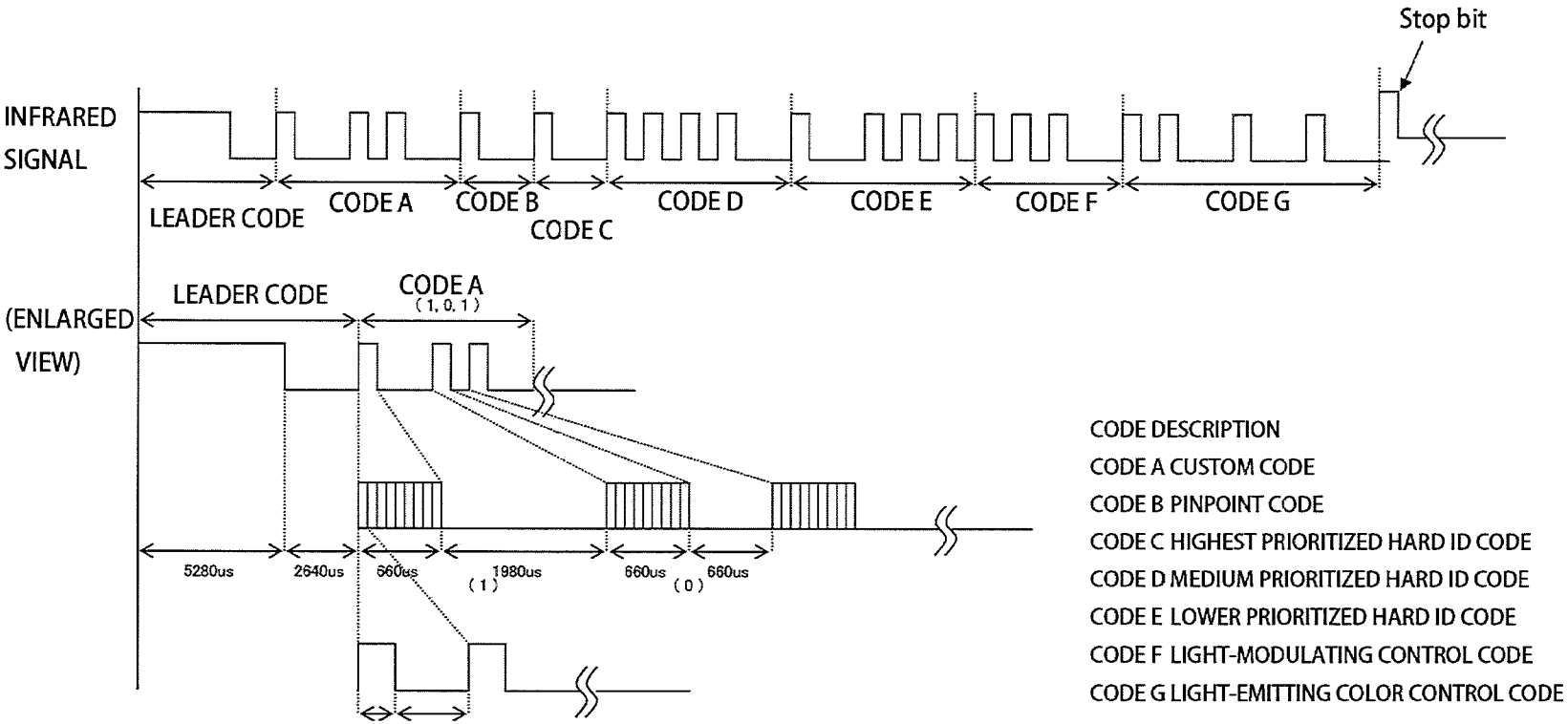
FIG. 3 is an explanatory view related to contents of an infrared signal.

Hereinafter, an embodiment for carrying out the present invention will be described. FIGS. 1(*a*) and 1(*b*) are explanatory views of a light emitting instruction apparatus 2 which constitutes a light emitting system 1 according to the present invention. FIG. 1(*a*) is a schematic block diagram illustrating a structure of the light emitting instruction apparatus 2 structured in a spot type as an example, and FIG. 1(*b*) is a structure diagram illustrating the light emitting instruction apparatus 2.

The light emitting instruction apparatus 2 includes an infrared light-emitting diode (hereinafter, refer to as a "light emitting means") 4 serving as an infrared output means, and a drive control portion 5 which performs the emission control of the light emitting means 4.

The drive control portion 5 includes a driving circuit portion which makes the light emitting means 4 emit an infrared ray. The drive control portion 5 stores or generates a control code which drives the light emitting device 3, and has a modulation means which modulates the infrared ray generated in the driving circuit portion using the control code. A signal generated in the drive control portion 5 is illuminated in a predetermined direction as an infrared signal by the light emitting means 4 after passing through a wave amplifying/shaping means 6.

The light emitting instruction apparatus 2 includes a power source 7, and an operation switch 8 which instructs to emit the infrared light by the light emitting means 4, besides the above-described means. Incidentally, two types of apparatuses are disclosed for the light emitting instruction apparatus.

One is structured as the spot-type shown in FIGS. 1(*a*) and 1(*b*) such that the infrared light illuminates only a relatively narrow range, and the other is structured as the wide-area type shown in FIGS. 6(*a*) and 6(*b*) such that the infrared light illuminates a wide area such as a concert hall. Hereinafter, the light emitting system 1 according to the present invention is described mainly referring to a spot-type light emitting instruction apparatus 2, while the details of the wide-area type will be described later.

FIG. 1(*b*) is the structure diagram of the spot-type light emitting instruction apparatus 2 as described above. As an example, it has a shape like a cylindrical casing so as to be hand-held. The appearance shape is not limited thereto, but, for example, it may be a shape which can be incorporated into a stage property such as a cane used in a theatrical performance, or a shape attachable to musical instruments, such as a guitar, during music playing.

The light emitting instruction apparatus 2 includes the above-described light emitting means 4, power source 7, operation switches 8, and drive control portion 5 within a casing 9 having a cylindrical shape to serve as a grasping portion. A front portion of the infrared light-emitting diode forming the light emitting means 4 is provided with an optical system means, such as a lens, for guiding the emitted infrared light forward. In the optical system means, a lens 10 is arranged to be moved in the front-back direction by a user's operation, so that an illumination range of illumination light by the infrared ray can be desirably expanded or reduced.

An exchangeable filter 11 (11*a*, 11*b*) which has a transmissive hole having a predetermined shape is provided at the front of the lens 10. The transmissive hole has a desired shape, such as a heart-like shape, a round shape, and a quadrangle, so that the shape of an area illuminated by the infrared light can be made to have a shape which is similar to that of the transmissive hole of the exchangeable filter 11.

Next, the light emitting device 3 will be described. FIG. 2(*a*) is a schematic block diagram of the light emitting device 3, and FIG. 2(*b*) is a structure diagram of the light emitting device 3. The light emitting device 3 mainly includes a light receiving means 12, a wave acquiring (wave amplifying/shaping) means 13, a drive control portion 14, a light emitting means 15 (15*a*, 15*b*, 15*c*), and a power source 16.

The light receiving means 12 is formed by a light receiving element, such as a photo diode, and can receive the infrared light (infrared signal) outputted by the light emitting means 4. The wave acquiring (wave amplifying/shaping) means 13 adjusts the infrared light received by the light receiving means 12 to have a voltage of a predetermined level and shapes a wave form so as to serve as an extracting means which extracts the control code from the modulated signal.

The drive control portion 14 controls each electric means included in the light emitting device 3 and serves as a means to perform drive control for making the light emitting means 15 emit light mainly based on the control code. The light emitting means 15 is formed by light sources, such as LEDs which emit visible light, and is constituted with the LEDs (15*a*, 15*b*, 15*c*) emitting lights in red, blue, and green, respectively, in this embodiment.

Next, the control code will be described. The control code is included in the infrared signal transmitted by the light emitting instruction apparatus 2. FIG. 3 shows an example of the control code included in the infrared signal. The first row in FIG. 3 shows an example of the control codes included in the infrared signal, the second row is an explanatory view in which portions of a leader code and a code A are enlarged in a time axis direction, the third row is an explanatory view which the portions of the leader code and the code A are further enlarged in the time axis direction, and the fourth row shows the minimum pulse width of the emitted infrared signal.

As shown in FIG. 3, the infrared signal includes the leader code, seven codes indicated as codes A to G, and a stop bit, as the control codes. The leader code and the stop bit are codes to be recognized as a beginning and an end of the control code, respectively. Each code arranged between the leader code and the stop bit serves as a control instruction for driving the light emitting device 3.

The code A is a custom code. This code is a verification code unique to a manufacturer to identify a product of the own company (manufacturer). The verification code verifies whether or not to be coincident with a code stored in the light emitting device 3. Only when they are coincident, the other control codes are accepted by the light emitting device 3 as instructions. The verification code also serves to manage manufacturing time and the like.

The code B is a pinpoint code. This code is a verification code indicating a type of the light emitting instruction apparatus 2, and determines whether or not to be coincident with an ID code included in the light emitting device 3.

In the embodiment, there are the spot-type light emitting instruction apparatus adapted to emit the infrared light only to a relatively narrow range, and the wide-area type light emitting instruction apparatus adapted to emit the infrared light over a wide area. This code identifies which apparatus transmits the infrared signal, and is provided for a purpose of executing a specific control which cannot be executed by the wide-area type light emitting instruction apparatus, by recognizing the ID code of the spot-type.

The codes C to E are hard ID codes. These codes are preliminary stored in the light emitting device 3 as needed, to verify whether or not to be coincident with the transmitted codes C to E. When they are coincident, an individual control can be executed, such as changing to a specific operation mode, disregarding or executing a specific control signal, or the like. For example, the codes may be assigned by client, talent, or other purposes to use the light emitting device 3 in different manners, and, when the same hard ID codes are received like the terminal ID, LEDs emit light according to instructions of control data for emitting and modulating light.

The codes F and G are an emission color control code and a light-modulating control code. These codes control the emission speed of the LEDs 15*a*, 15*b*, 15*c* in three colors, which are mounted to the light emitting device 3, by repeating light-emitting and light-off signals.

Next, the main operation of the light emitting device 3 which receives the infrared signal will be described with reference to the flow chart shown in FIG. 4.

When a power switch of the light emitting device 3 is turned on, the LEDs 15*a*, 15*b*, 15*c* are lighted or blinked with an emission pattern which is stored to operate at a time of no signal (S1), and the infrared signal becomes in the receivable state by the light receiving means 12.

When the infrared signal is received, the control code is extracted by the wave acquiring means 13, and the drive control portion 14 determines whether or not the code A included in the signal is coincident with the verification codes included in an identification information which is stored in the light emitting device 3 (S2). The verification codes include the code A and the codes C to E output by the emitting instruction apparatus 2. As a result of determination, when the extracted control code does not include the code A (is inconsistent with the identification information stored in the light emitting device 3), the process returns to the receivable state of the infrared signal (S1). When the code A is consistent with the identification information stored in the light emitting device 3, the content of the code B is determined as a next step (S4).

In the embodiment, the code B indicates either one of "1" and "0 (other than 1)". When the code B is "1", the light emitting instruction apparatus 2 is determined as the "spot type", and, when the code B is "other than 1", the light emitting instruction apparatus 2 is determined as other than "spot type" ("wide-area type" in the present embodiment).

In the case of "the code B=1," after storing a current emission color and modulated light value in a storage area inside the drive control portion 14 (S5), the LEDs (15*a*, 15*b*, 15*c*) emit light according to the content specified by the code G which is an emission color control code (S6). Then, a timer is set for 0.5 second concurrently with the emission (S7), a set time set by the timer is counted, and each of the LEDs is made to emit light based on the emission color and modulated light value stored at the step S5 with the lapse of the set time (S9). After the step S9, the process returns again to the receivable state of the infrared signal (S1).

According to the embodiment, the timer time set to 0.5 second is a fixed data preliminarily stored in the light emitting device 3. During a certain period of time where the timer is effective, light is emitted according to the contents based on other control codes transmitted together with the code B=1. During this certain period of time, no interrupt is permitted even if the control signal is transmitted from the light emitting instruction apparatus.

While the timer time is set to be a fixed value, the light emitting device may be provided with an adjusting means so as to set a desired period of time. In addition, the light emitting instruction apparatus may transmit a signal for setting a timer time together with the control code "the code B=1," to perform a timer operation according to the transmitted set time.

Figure 4:
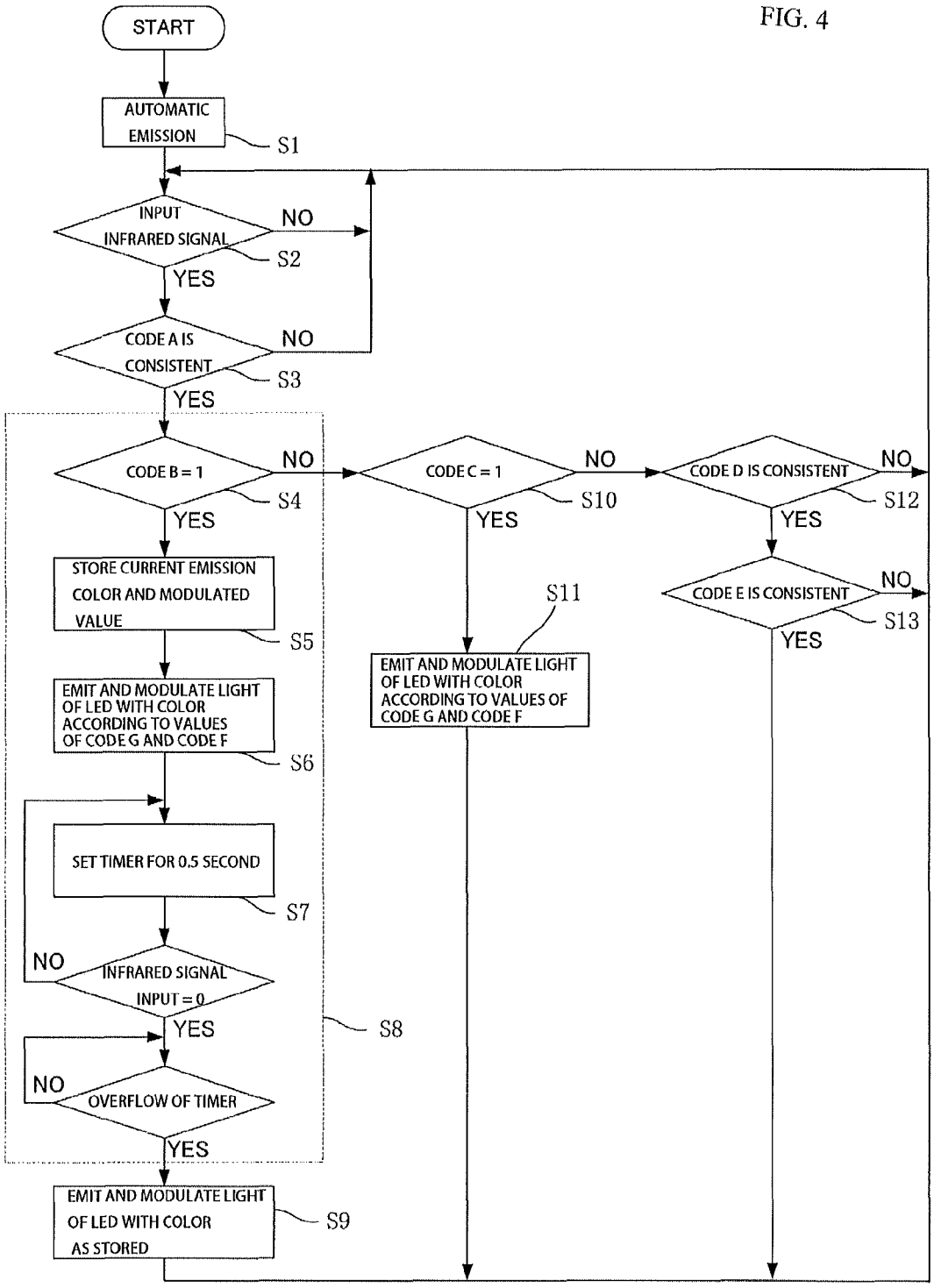
FIG. 4 is a flow chart of a light emitting system according to the present invention.

The processes (S8) after light is emitted according to the emission color and modulated light value set in the step S6 upon determination of "the code B=1" (S4) until the process return to a state before determining "the code B=1" entails, in actuality, complicated processes, although FIG. 4 shows a summarized description. The step S8 includes the processes until completing light emission associated with "the code B=1," and performs the processes corresponding to various conditions in various states, such as, where the light emitting device 3 can continuously receive "the code B=1," can sporadically receive, or can receive no infrared signal. Then, the processes (S8) are to obtain stage effects as shown in FIGS. 5(*a*) and 5(*b*).

FIGS. 5(*a*) and 5(*b*) show spectators, each of those who holds the light emitting device 3 in one hand in a concert hall, as an example. FIG. 5(*a*) shows a state in which all of the light emitting devices 3 held by the spectators emit light in the same color and the same modulated light value, or a state in which lights are switched off. Generally, the state is obtained by transmitting the control signal by the wide-area type light emitting instruction apparatus to the entire hall.

In the state in FIG. 5(*a*), when the spectators are illuminated by the "spot-type" light emitting instruction apparatus 2, the control signal reaches only to one partial area W as shown in FIG. 5(*b*). Therefore, the light emitting devices 3 distributed over the hall are divided between the ones receiving the infrared signal from the "spot-type" light emitting instruction apparatus 2, and the others receiving no infrared signal. Only the light emitting devices 3 existing in the area W perform a predetermined light emission by the control code from the "spot-type" light emitting instruction apparatus 2. In the example described above, the light emitting devices 3 emit light in a predetermined color only for 0.5 second upon receiving the infrared signal, and then, return to a state before the emission.

When the area W illuminated by the infrared signal from the light emitting instruction apparatus 2 is continuously moved, the light emitting devices 3 existing in an area which changes according to the movement of the area W successively emit light in a predetermined color, and then, return to an original state in 0.5 second. As an effect represented for an stage effect, an area designated by the light emitting instruction apparatus 2 is lighted up with emission of the light emitting devices 3 as if being exposed by a spotlight, and, according to the movement of the area W, light like a persistence of vision is emitted just for a slight time in a lingering manner even after the area W is moved away. Then, the light emitting devices 3 in that area are switched off or return to an original light emitting state.

The code B has the highest priority irrespective of the presence or absence of the codes C to E indicating an individual information (hard ID) of the light emitting device 3. Even when a plurality of different types of the light emitting devices 3 each having a different hard ID code exist, by determining "the code B=1," the code B is followed preferentially over a signal transmitted by the "spot-type" light emitting instruction apparatus 2, regardless of consistency or inconsistency of the hard IDs. The code B has the highest priority to be executed over the other control codes.

When "the code B=1" is not determined in the step S4, whether or not "the code C=1" (a hard ID of the light emitting device 3 is equal to the code C) is determined (S10). In the case of "the code C=1", light in a color matched with a value of the code G is turned on, and is modulated according to the content of the code F (S11).

The code F, as a 3-bit data, enables brightness to be set at eight levels (from light-off to lighting at the maximum brightness level). The code G, also as a 3-bit data, modulates light of LEDs in three colors to emit light in eight different colors (red, green, blue, yellow, cyanogen, magenta, white, black (light-off)).

When "the code C=1" is not determined in the step S10, in order to further determine consistency with other hard IDs, it is determined whether or not a hard ID of the light emitting device 3 is consistent with "the code D" (S12) and it is determined whether or not a hard ID of the light emitting device 3 is consistent with "the code E" (S13).

Although not illustrated in the flow chart, processes which are executed in the case of the consistency with "the code D" or "the code E" may be appropriately provided. The process returns to the receivable state of the infrared signal (S2) upon completion of the processes.

On the other hand, when none of the hard IDs is consistent with the hard codes C to E, the process is returned to the receivable state of the infrared signal (S2).

Since spectators holding the light emitting devices 3 are distributed over a wide range in a large concert hall, the "wide-area type" light emitting instruction apparatus is used when all of the light emitting devices 3 held by the spectators are synchronized to emit light. FIG. 6(*a*) shows a panel surface of a controller 20 which operates the "wide-area type" light emitting instruction apparatus. As shown in FIG. 6(*b*), the "wide-area type" light emitting instruction apparatus includes a floodlight 30 which mounts a plurality of LEDs for emitting infrared light, the controller 20 which controls the floodlight 30, a drive control portion 28, and a wave amplifying/shaping means 29. Further, a plurality of floodlights may be connected to one controller for use, as needed.

The panel surface of the controller 20 is, as an example, provided with a power switch 21, an ID setting dial 22, a spotting mode on/off switch 23, a light control volume 24, a blink speed adjusting volume 25, an emission color instruction switches 26 (26*a*, 26*b*, 26*c*, 26*d*, 26*e*, 26*f*, 26*g*, 26*h*), and a light-off switch 27.

The ID setting dial 22 is an ID setting means used to set hard IDs, such as the codes C to E, as described above. By using each of the switches of the controller 20, the "wide-area type" light emitting instruction apparatus performs settings for selecting an emission color, modulating the emission color, adjusting brightness, switching off light, adjusting a blink speed, and the like. After generating a control signal having the settings, the "wide-area type" light emitting instruction apparatus generates a predetermined infrared signal and output the signal via the large-sized floodlight 30.

Industrial Applicability

The present invention is applicable to a stage effect system which produces stage effects by controlling light emission of penlights held by spectators in a concert hall.

REFERENCE SIGNS LIST

1 Light emitting system
2 Light emitting instruction apparatus
3 Light emitting device
4 Light emitting means
5 Drive control portion
6 Wave amplifying/shaping means
7 Power source
8 Operation switch
9 Casing
10 Lens
11 (11*a*, 11*b*) Filter
12 Light receiving means
13 Wave acquiring (wave amplifying/shaping) means
14 Drive control portion
15 (15*a*, 15*b*, 15*c*) Light emitting means
16 Power source

What is claimed is:

1. A light emitting system comprising:

a light emitting instruction apparatus; and a light emitting device, wherein the light emitting instruction apparatus includes an infrared output which outputs an infrared signal modulated by a control code, the light emitting device includes a receiver which receives the infrared signal, an extractor which extracts the control code from the infrared signal acquired by the receiver, a light emitter which emits visible light in a plurality of colors, and a controller which executes drive control of the light emitter, the control code transmitted by the light emitting instruction apparatus includes a plurality of verification codes which verifies whether or not to be coincident with ID codes preliminarily stored in the light emitter, and the plurality of verification codes is prioritized and performs operations with contents of control according to a priority of the received verification codes.

2. The light emitting system according to claim 1, wherein, upon receipt of a highest prioritized verification code, the light emitting device stores a content of current control and executes another predetermined control temporarily or only for a certain period of time, and performs an operation based on the stored content of the control after the other predetermined control is completed.

3. The light emitting system according to claim 2, wherein, upon receipt of the highest prioritized verification code, the light emitting device emits light by the light emitter after storing the content of the current control, and switches off the light emitter after a lapse of a predetermined time from light emission.

4. The light emitting system according to claim 2, wherein the light emitting instruction apparatus is configured to transmit at least a verification code having the highest priority, and the light emitting instruction apparatus is further configured not to transmit the verification code having the highest priority.

5. The light emitting system according to claim 1, wherein, upon receipt of a highest prioritized verification code, the light emitting device emits light by the light emitter after storing a content of current control, and switches off the light emitter after a lapse of a predetermined time from light emission.

6. The light emitting system according to claim 5, wherein the light emitting instruction apparatus is configured to transmit at least a verification code having the highest priority, and the light emitting instruction apparatus is further configured not to transmit the verification code having the highest priority.

7. The light emitting system according to claim 1, wherein the light emitting instruction apparatus is configured to transmit at least a verification code having the highest priority, and the light emitting instruction apparatus is further configured not to transmit the verification code having the highest priority.

8. The light emitting instruction apparatus of claim 1, wherein the light emitting instruction apparatus includes an optical adjuster configured to expand and reduce an illumination range of the infrared signal.

9. A light emitting instruction apparatus for controlling a plurality of light emitting devices, each of the plurality of light emitting devices having a light emitter for emitting visible light, comprising:

an infrared output which outputs an infrared signal modulated by a control code; and an optical adjuster which expands and reduces an illumination range of the outputted infrared signal for selectively controlling the plurality of light emitting devices having a light emitter for visible light.

10. The light emitting instruction apparatus according to claim 9, comprising a shaper which shapes an area illuminated by the infrared signal.

11. The light emitting instruction apparatus according to claim 10, comprising an instructor which specifies an emission color for the light emitters.

12. The light emitting instruction apparatus according to claim 9, comprising an instructor which specifies an emission color for the light emitters.

13. The light emitting instruction apparatus according to claim 9, wherein the optical adjuster is configured to expand and reduce a width of the outputted infrared signal.

* * * * *